US007156946B2

(12) United States Patent
Walsh et al.

(10) Patent No.: US 7,156,946 B2
(45) Date of Patent: Jan. 2, 2007

(54) WAFER CARRIER PIVOT MECHANISM

(75) Inventors: Thomas A. Walsh, San Luis Obispo, CA (US); William J. Kalenian, San Luis Obispo, CA (US)

(73) Assignee: Strasbaugh, San Luis Obispo, CA (US)

( * ) Notice: Subject to any disclaimer, the term of this patent is extended or adjusted under 35 U.S.C. 154(b) by 59 days.

(21) Appl. No.: 10/425,896

(22) Filed: Apr. 28, 2003

(65) Prior Publication Data

US 2004/0226656 A1 Nov. 18, 2004

(51) Int. Cl.
*C23F 1/00* (2006.01)

(52) U.S. Cl. ..... 156/345.12

(58) Field of Classification Search ..... 451/119, 451/158, 159, 177, 259, 278, 279, 283, 285, 451/287, 288, 392, 398; 156/345.12; 403/57
See application file for complete search history.

(56) References Cited

U.S. PATENT DOCUMENTS

| | | | | |
|---|---|---|---|---|
| 5,377,451 | A * | 1/1995 | Leoni et al. | 451/287 |
| 5,538,346 | A | 7/1996 | Frias et al. | 384/49 |
| 5,738,568 | A | 4/1998 | Jurjevic et al. | 451/41 |
| 5,830,806 | A | 11/1998 | Hudson et al. | 438/690 |
| 5,868,609 | A | 2/1999 | Aaron et al. | 451/285 |
| 5,916,015 | A | 6/1999 | Natalicio | 451/288 |
| 5,989,104 | A | 11/1999 | Kim et al. | 451/41 |
| 6,106,379 | A | 8/2000 | Mosca | 451/288 |
| 6,494,769 | B1 | 12/2002 | Sinclair et al. | 451/288 |
| 6,506,104 | B1 | 1/2003 | Perlov et al. | 451/288 |
| 6,511,368 | B1 | 1/2003 | Halley | 451/287 |
| 6,514,121 | B1 | 2/2003 | Halley | 451/5 |
| 6,517,419 | B1 | 2/2003 | Halley | 451/56 |
| 6,540,592 | B1 * | 4/2003 | Schultz et al. | 451/285 |
| 6,652,357 | B1 * | 11/2003 | Williams | 451/8 |

FOREIGN PATENT DOCUMENTS

| | | |
|---|---|---|
| EP | 0361745 A1 * | 4/1990 |
| JP | 61-25767 | 2/1986 |
| JP | 61-25768 | 2/1986 |
| JP | S63-62668 | 3/1988 |
| WO | WO 02/42033 A1 * | 5/2002 |

OTHER PUBLICATIONS

"Compact Ball Transfer Units." From Illustrated Sourcebook of Mechanical Components. p. 15-39. Edited by: Parmley, R.O. 2000 McGraw-Hill.*

(Continued)

*Primary Examiner*—Parviz Hassanzadeh
*Assistant Examiner*—Maureen G. Arancibia
(74) *Attorney, Agent, or Firm*—K. David Crockett, Esq.; Crockett & Crockett

(57) ABSTRACT

A pivoting wafer carrier having a minimum of internal friction and a smooth, continuous pivoting motion. The pivot mechanism includes a lower ring mounted on a pressure plate, an upper ring mounted on a housing upper plate and ball transfer units disposed on the lower ring. Corresponding bearing wedges depend downwardly from the upper ring. As the pressure plate tilts during the polishing process, the load balls of the ball transfer units roll against the corresponding wedges, thus producing a smooth, continuous pivoting motion. A universal joint may be provided to the carrier to effect the rotation of the carrier and to aid the smooth, continuous pivoting motion of the wafer carrier.

23 Claims, 5 Drawing Sheets

OTHER PUBLICATIONS

"X-Life Ultra Bearings Provide Long Life, Corrosion Resistance." Barden Corporation Press Release, dated Sep. 25, 2002. Obtained from http://news.thomasnet.com/fullstory/14542 on Nov. 12, 2004.*

"How aerospace material enhances tool applications" by Rudolf Walter. Originally published in the Mar. 2000 issue of Tooling & Production. Obtained on Jul. 12, 2005 from http://www.manufacturingcenter.com/tooling/archives/0300/0300tu.asp.*

* cited by examiner 21
10
1
20
5
5
4
22
2
2
3
3
8
8
9
9
7
6

WAFER CARRIER PIVOT MECHANISM

FIELD OF THE INVENTIONS

The inventions described below relate the field of wafer carriers used to hold wafers during chemical mechanical planarization.

BACKGROUND OF THE INVENTIONS

Integrated circuits, including computer chips, are manufactured by building up layers of circuits on the front side of silicon wafers. An extremely high degree of wafer flatness and layer flatness is required during the manufacturing process. Chemical mechanical planarization (CMP) is a process used during device manufacturing to flatten wafers and the layers built-up on wafers to the necessary degree of flatness.

Chemical mechanical planarization is a process involving polishing of a wafer with a polishing pad combined with the chemical and physical action of a slurry pumped onto the pad. The wafer is held by a wafer carrier, with the backside of the wafer facing the wafer carrier and the front side of the wafer facing a polishing pad. The polishing pad is held on a platen, which is usually disposed beneath the wafer carrier. Both the wafer carrier and the platen are rotated so that the polishing pad polishes the front side of the wafer. A slurry of selected chemicals and abrasives is pumped onto the pad to affect the desired type and amount of polishing. (CMP polishing is therefore achieved by a combination of chemical softener and physical down force that removes material from the wafer or wafer layer.) Using this process a thin layer of material is removed from the front side of the wafer or wafer layer. The layer may be a layer of oxide grown or deposited on the wafer or a layer of metal deposited on the wafer. The removal of the thin layer of material is accomplished so as to reduce surface variations on the wafer. Thus, the wafer and layers built-up on the wafer are very flat and/or uniform after the process is complete. Typically, more layers are added and the chemical mechanical planarization process repeated to build complete integrated circuit chips on the wafer surface.

Many wafer carriers are provided with a gimbal mechanism or pivot mechanism in order to improve the uniformity of wafer film removal and to improve planarity. The pivot mechanism allows the wafer (and a pressure plate) to tilt, wobble, gimbal, or pivot within the wafer carrier. Thus, the surface of the wafer will remain flush with the polishing pad during rotational polishing, despite misalignment of various parts of the polishing apparatus. Misalignment can occur in the platen, the spindle shaft, the wafer carrier, the table and other parts of the polishing apparatus. In addition, the wafer can be misaligned on the carrier and surface variations present on the polishing pad can cause the wafer not to be completely parallel to the pad. However, the pivot mechanism on the carrier allows the wafer to remain parallel with respect to the pad. Because the wafer remains parallel with respect to the pad, the pivot mechanism allows a predictable amount of film to be removed during polishing.

Pivot mechanisms have been proposed for wafer carriers. An example of a pivoted wafer carrier is shown in Kim et al., Workpiece Carrier with Monopiece Pressure Plate and Low Pivot point, U.S. Pat. No. 5,989,104 (Nov. 23, 1999). Kim shows a gimbal mechanism comprising nested bearing rings that rotate relative to each other via pins disposed in the bearing rings. Aaron et al., Wafer Carrier Rotating Head Assembly for Chemical-Mechanical Polishing Apparatus, U.S. Pat. No. 5,868,609 (Feb. 9, 1999) shows a carrier head that pivots around a central sphere. Hudson et al., Wafer Backing Member for Mechanical and Chemical-Mechanical Planarization of Substrates, U.S. Pat. No. 5,830,806 (Nov. 3, 1998) also shows a wafer carrier that pivots around a central sphere. Sinclair et al., Wafer Carrier For Chemical Mechanical Planarization Polishing, U.S. Pat. No. 6,494,769 (Dec. 17, 2002) shows a wafer carrier in which the entire carrier pivots around the chuck of the carrier. Perlov et al., Carrier Head with a Flexible Membrane, U.S. Pat. No. 6,506,104 (Jan. 14, 2003) shows a wafer carrier having a pivot mechanism comprising a series of ball bearings disposed in a retainer surrounding the base.

A problem remains, however, in that the actual pivoting motion in such wafer carriers is not as smooth or continuous as possible due to friction within the pivoting mechanism. Internal friction causes a lag in the ability of the pivot mechanism to keep the carrier in alignment with the pad. (Friction causes moving components to chatter, or to start and stop at high frequency, thereby causing the lag in the ability of the pivot mechanism to align continuously with the pad.) Thus, portions of the wafer will be pushed either too much or too little against the polishing pad. This results in non-uniform film removal, and hence results in variations in flatness or uniformity of the wafer or layer. These variations can be significant given the extreme tolerances (fractions of a micron in some cases) required during wafer or chip manufacturing.

SUMMARY

The methods and devices shown below provide for a wafer carrier having a pivot mechanism that pivots or wobbles with a minimum of friction during polishing. The pivot mechanism causes a carrier pressure plate to continuously tilt (relative to a carrier housing upper plate that does not tilt during polishing) in order to keep the pressure plate (and hence the wafer) parallel to the pad. A universal joint may be provided within the carrier to transfer rotational force from the housing upper plate to the pressure plate while allowing the carrier to pivot within narrow limits. The universal joint is designed to allow the carrier to pivot smoothly and with a minimum of friction and chattering.

The pivot mechanism includes an upper ring disposed on the housing upper plate, a lower ring disposed on the pressure plate and ball transfer units disposed on the lower ring. Corresponding bearing wedges are mounted on the upper ring. The ball transfer units are disposed on the lower ring to face the wedges. The ball transfer units and wedges are further disposed so that the load balls of the transfer units may roll against the wedges when the carrier is assembled. Thus, the lower ring may pivot relative to the upper ring with a minimum of friction and with a smooth, continuous motion.

DETAILED DESCRIPTION OF THE INVENTIONS

Figure 1:
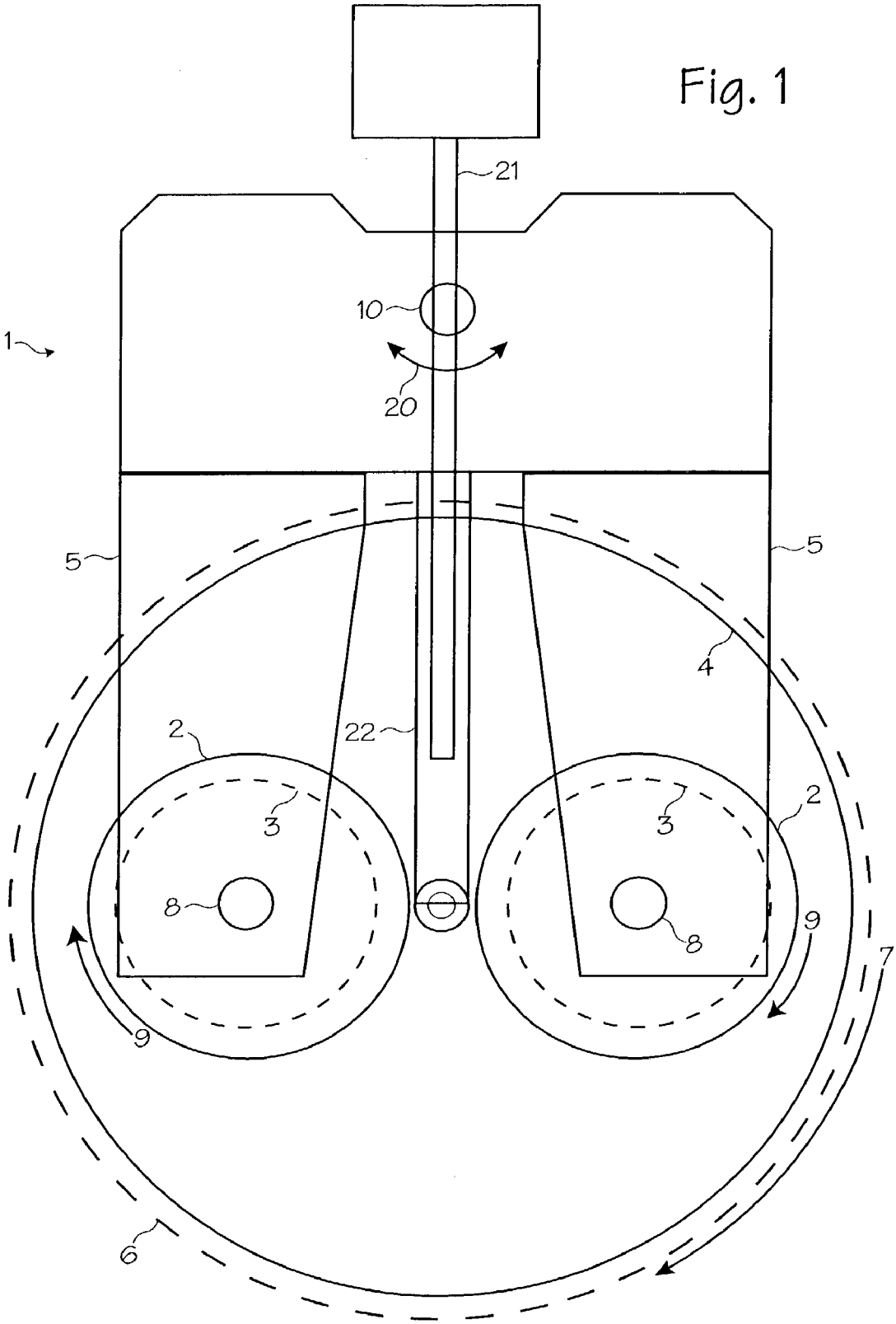
FIG. 1 shows a system for performing chemical mechanical planarization.

FIG. 1 shows a system 1 for performing chemical mechanical planarization. One or more polishing heads or wafer carriers 2 hold wafers 3 (shown in phantom to indicate their position underneath the wafer carrier) suspended over a polishing pad 4. The wafer carriers are suspended from translation arms 5. The polishing pad is disposed on a platen 6, which spins in the direction of arrows 7. The wafer carriers 2 rotate about their respective spindles 8 in the direction of arrows 9. The wafer carriers are also translated back and forth over the surface of the polishing pad by the translating spindle 10, which moves as indicated by arrows 20. The slurry used in the polishing process is injected onto the surface of the polishing pad through slurry injection tube 21, which is disposed on or through a suspension arm 22. (Other chemical mechanical planarization systems may use only one wafer carrier that holds one wafer, or may use several wafer carriers that hold several wafers. Other systems may also use separate translation arms to hold each carrier.)

Figure 2:
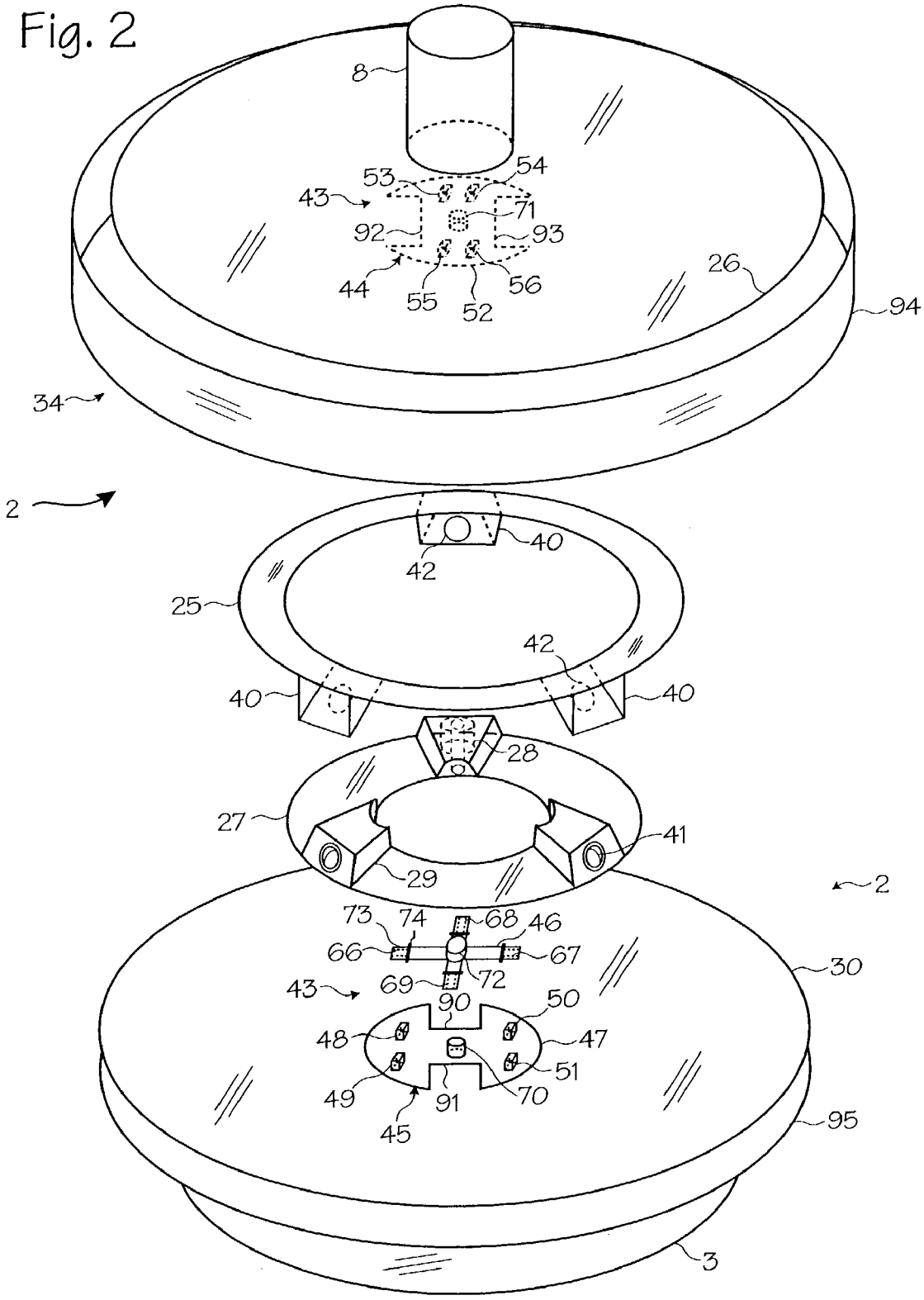
FIG. 2 shows an exploded view of a wafer carrier with a pivot mechanism.

FIG. 2 shows an exploded view of a wafer carrier 2 with a pivoting mechanism which permits limited rotation of the pressure plate about the horizontal axes, relative to the carrier housing. The pivoting mechanism includes a circular array of bearings and a spherical race. The spherical race includes an upper ring 25 with several wedges depending downwardly from the upper ring to establish bearing surfaces. The spherical race is disposed on the housing upper plate of carrier housing 34. The circular array of bearings is formed by a lower, ring 27 with several ball transfer units 28 contained within housings 29 disposed on the lower ring. The circular array is disposed on a manifold plate or pressure plate 30.

The ball transfer units are evenly spaced around the lower ring. For example, three ball transfer units may be mounted on the lower ring, separated by 120° around the ring. Though most conveniently arranged in a circular array (an array with all load balls on the same sphere and on the same plane), the ball transfer units may also be arranged in a spherical array (with the load balls located on the same sphere, but on different planes) if the wafer carrier is otherwise balanced. Corresponding wedges 40 are disposed on the upper ring, depending downwardly toward the lower ring. The inwardly facing bearing surfaces of the wedges are provided with an arcuate shape (a section of a sphere) to receive the load balls 41 of the corresponding ball transfer units. Ball-receiving inserts 42 may be disposed on the bearing surface of inwardly facing wedges. The ball-receiving inserts are provided with the same arcuate shape as the inwardly facing bearing surfaces of the wedges. The ball-receiving inserts are attached to the wedges by any suitable means, and may be removably attached to allow the inserts to be easily replaced when they become worn. As illustrated, the upper ring and lower ring are sized, dimensioned and disposed relative to each other so that the lower ring fits coaxially beneath the upper ring.

The wedges 40 on the upper ring and corresponding ball transfer units on the lower ring are aligned on the respective rings so as to be placed adjacent to each other when the carrier is assembled, with the load balls in apposition to the bearing surfaces of the wedges. The ball transfer units bear the downward force of the carrier. The load balls roll smoothly and continuously (with a minimum of friction) against the ball-receiving inserts as the pressure plate wobbles, rocks, tilts or pivots during polishing. Thus, the pivoting mechanism allows the carrier pressure plate to pivot and wobble smoothly and continuously as the carrier is moved over the polishing pad, even if the carrier is under a heavy load.

While the pivot mechanism allows the pressure plate to pivot about the horizontal axes with respect to the housing upper plate, a universal joint 43 is provided to transmit rotational force from the housing upper plate to the pressure plate. The universal joint includes an upper yoke 44, a lower yoke 45 and a cross member or spider 46. The universal joint shown in FIG. 2 transfers rotational force from the housing upper plate to the pressure plate, and, due to the open yoke structure of the universal joint, also allows the spider legs and pressure plate to move up and down slightly with respect to the housing upper plate. The yoke structure is open in the sense that the spider permitted to move a small distance axially (along the axis of rotation of the wafer carrier) relative to the two parts that are rotationally joined by the spider. The universal joint may therefore be referred to as an expandable universal joint.

The lower yoke includes a lower mounting plate 47, a first receiving post 48, a second receiving post 49, a third receiving post 50 and a fourth receiving post 51. The lower yoke is attached to the pressure plate 30. The upper yoke includes an upper mounting plate 52, a fifth receiving post 53, a sixth receiving post 54, a seventh receiving post 55, and an eighth receiving post 56. The upper yoke is attached to the housing upper plate 26. (The upper yoke and upper pivot post 71 are shown in phantom to indicate their positions underneath the housing upper plate 26.) Though conveniently provided as discrete parts, the yokes may be formed integrally the parts, such as the rings or plates, to which they are fixed. Also, though conveniently located coaxially within the lower ring and the upper ring, the universal joint may also be constructed coaxially outside the upper ring and lower ring, for example by joining the housing ring and the pressure plate with spider legs.

The spider 46 is designed to aid in the smooth and continuous pivoting or wobbling motion of the pressure plate. The spider 46 is a cross-shaped piece of rigid material, such as metal or hard plastic, having a first leg 66, a second leg 67, a third leg 68 and a fourth leg 69. The lower surface of the spider may be provided with a depression or a hollow to accommodate a lower pivot post 70 disposed on the lower yoke. Likewise, the upper surface of the spider may be provided with a depression to accommodate an upper pivot post 71 disposed on the upper yoke. The central portion 72 of the spider may be wide enough to accommodate the depressions. The central portion of the spider tilts around the lower pivot post 70 and the upper pivot post 71.

A bushing 73 may be disposed on each of the ends of the spider legs. (The bushing may also comprise a cap, sleeve, fitting or other covering that allows the spider to be secured within the receiving posts but also allows the spider to rotate about each cross member.) The bushings fit between the receiving posts, thus securing the spider with respect to the lower and upper yokes. The bushings may be provided with a shoulder or flange 74 to further secure the spider between the receiving posts. As illustrated, the end of each leg of the spider is cylindrical to allow the spider to turn smoothly and continuously within the bushings, while the bushings have a square outer cross-section. The bushings and ends of the spider legs may move up and down slightly within each pair of receiving posts.

The spider is rotationally secured to the lower yoke by nestling the bushings and ends of the spider legs between the lower two pairs of receiving posts. The spider is rotationally secured to upper yoke by nestling the bushings and ends of the spider legs between the upper two pairs of receiving posts. The first pair of lower receiving posts is disposed opposite the second pair of lower receiving posts. The first pair of upper receiving posts is disposed opposite the second pair of upper receiving posts, and the upper pairs of receiving posts are oriented perpendicular to the lower pairs of receiving posts.

Both the upper yoke 52 and lower yoke 47 may be provided with spaces or insets to accommodate the receiving posts attached to the other yoke. Specifically, in the lower yoke, insets 90 and 91 accommodate the receiving posts of the upper yoke. In the upper yoke insets 92 and 93 accommodate the receiving posts of the lower yoke.

The wafer carrier is also provided with a mounting ring or housing ring 94 and a means for securing the wafer to the wafer carrier. (The housing ring and housing upper plate together comprise the housing of the wafer carrier.) The housing ring shields the inside of the carrier from slurry. The means for securing the wafer to the wafer carrier may comprise a vacuum supplied through the pressure plate and through a wafer mounting plate 95 (which is fixed to the pressure plate 30), a vacuum supplied to a membrane disposed between the wafer mounting plate 95 and the wafer, a retaining ring, a combination of these devices and methods or any other suitable means for holding a wafer during polishing.

When the carrier is assembled, the spider 46 is rotationally trapped in the yokes, thus rotationally securing the spider relative to the pressure plate 30 and housing upper plate 26. The lower ring 27 is fixed to the pressure plate, with the spider located in the center of the lower ring. The ball transfer units 28 are secured to the lower ring. The upper ring 25 is secured to the housing upper plate. Wedges 40 depend from the upper ring and are aligned such that the load balls 41 may roll against the inner faces of the wedges as the pressure plate tilts, pivots and wobbles. Rotational force is transferred from the spindle, through the housing upper plate and upper yoke, through the upper receiving posts, through the spider, through the lower receiving posts, through the pressure plate and to the wafer. Downward force is transferred from the housing upper plate, through the upper ring, through the ball transfer units, through the lower ring, through the pressure plate, and to the wafer.

Figure 3:
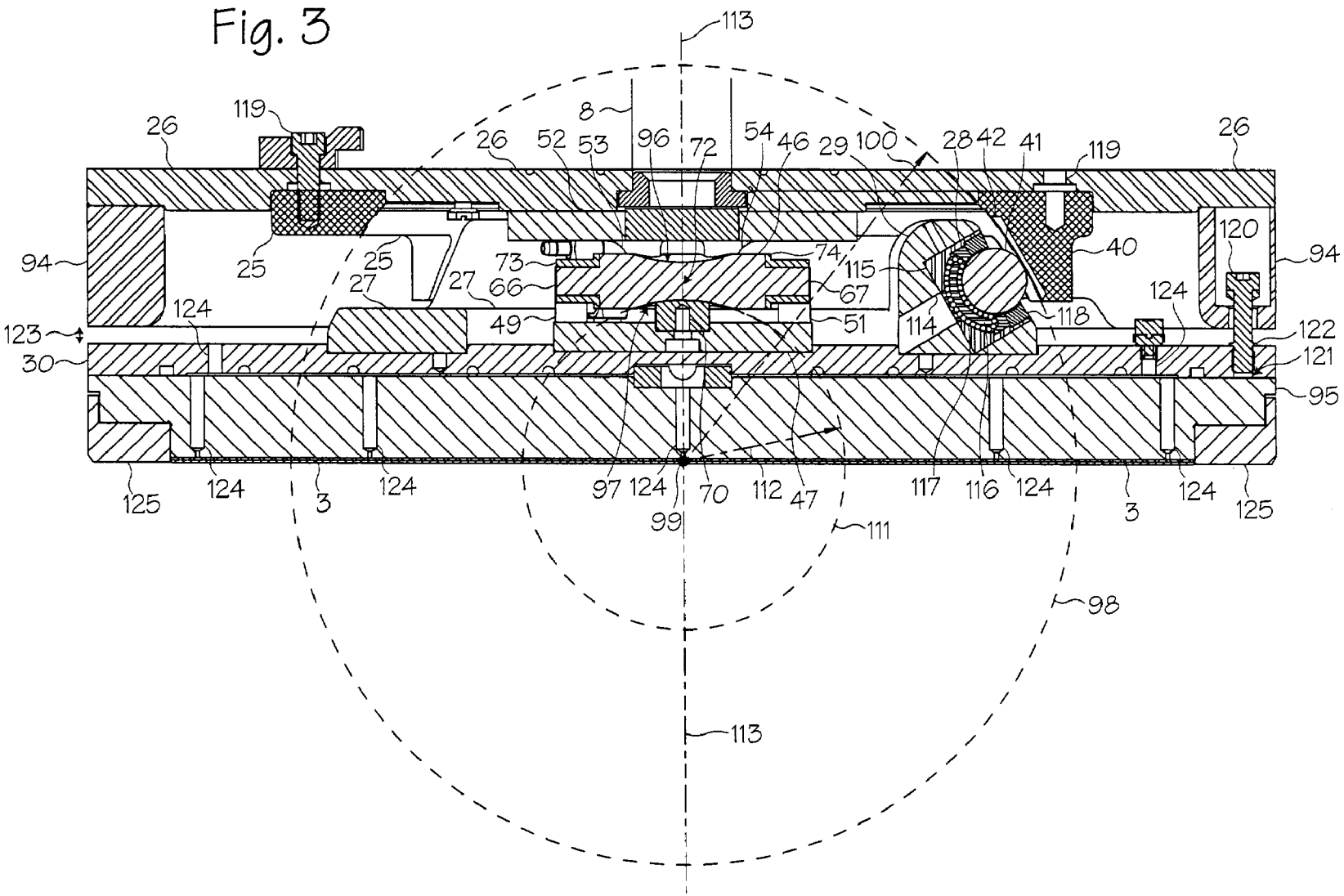
FIG. 3 shows a cross section of the wafer carrier with a pivot mechanism.
Figure 4:
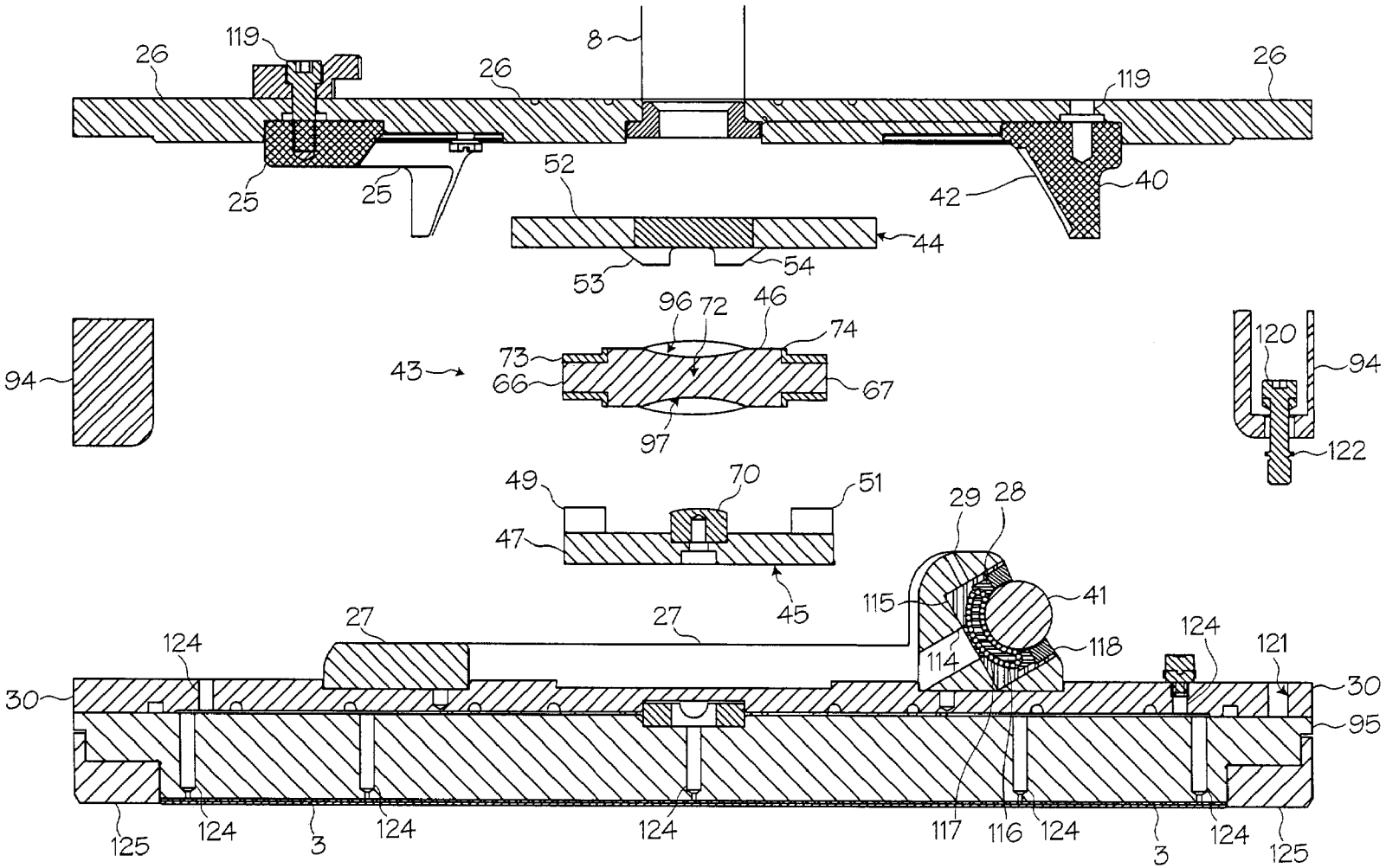
FIG. 4 shows an exploded cross section of the wafer carrier with a pivot mechanism.

FIGS. 3 and 4 show a cross section of the wafer carrier with a pivot mechanism. The upper ring 25 is fixed to the bottom of the housing upper plate 26. The lower ring 27 is fixed to the top of the pressure plate 30. The ball transfer units 28 are contained within housings 29, which are disposed on the lower ring 27. For each ball transfer unit, a corresponding wedge 40 depends from the upper ring to present an inwardly facing bearing surface for contact with the ball. The wedges are secured to the upper ring 25 or formed integrally with the upper ring. The bearing surfaces and corresponding load balls 41 are aligned to be placed opposite each other when the carrier is assembled. The load balls roll smoothly and continuously against the bearing surfaces as the pressure plate tilts or wobbles during polishing. Thus, the pivot mechanism allows the pressure plate to tilt smoothly and continuously as the carrier is moved over the polishing pad, even if the carrier is under a heavy load.

The upper surface 96 of the center 72 of the spider may be provided with an inwardly curving spherical section of a spherical surface, or a depression, to accommodate the upper pivot post 71. The lower surface 97 of the center of the spider may be provided with an inwardly curving spherical section of a spherical surface, or a depression, to accommodate the lower pivot post 70. The spider 46 is not fixed in orientation with respect to either the housing upper plate 26 or the pressure plate 30, except with respect to rotational motion. In other words, the spider floats, or is not fixed with respect to either the upper pivot post 71 or the lower pivot post 70. In this case, the upper surface of the spider moves against the upper pivot post and the lower surface of the spider moves against the lower pivot post. The ends of the spider legs remain between the receiving posts, confined within the yokes, though the bushings may move up and down slightly relative to the receiving posts. The ends of the legs of the spider turn within their bushings, and/or slide up and down within the constraints of the yoke posts as the pressure plate wobbles or pivots.

The carrier pressure plate pivots around a gimbal point or a pivot point. The pivot point is the point around which the carrier wobbles. The bearing surfaces of the wedges, as well as the corresponding ball-receiving inserts, are provided with a particular curvature which sets the pivot point, and thus affects how the pivot mechanism will tilt the wafer during polishing. Specifically, the curvature is set such that an imaginary sphere having a particular radius would fit snugly against the bearing surfaces of the wedges and against the ball-receiving inserts. (In other words, the wedges and ball-receiving inserts have a concave surface facing the load balls, and this surface is a spherical section of a spherical surface.) The center of the imaginary sphere is the pivot point.

The pivot point may be established at different points along the vertical axis (axis of rotation) of the carrier by adjusting the geometry of the pivot mechanism. In the carrier of FIGS. 2 and 3, the curvature of the bearing faces of the wedges is set to match the curvature of an imaginary sphere 98 (shown in phantom) having a center 99 at the center of the wafer and at the center of the interface between the pad and the wafer. The radius of the imaginary sphere is shown by phantom line 100. The center of the imaginary sphere is the center of curvature of the wedges and is the pivot point.

In addition, the depression of the spider lower surface may have a curvature set to correspond to that of a second imaginary sphere 111 that is co-centric with that of imaginary sphere 99. Thus, the radius of curvature of the depression in the spider may correspond to that of the bearing faces of the wedges. The radius of the second imaginary sphere is shown by phantom line 112.

The pivot point may also be set by adjusting the ball transfer units relative to the wedges (or upper ring). For example, the ball transfer unit housings may have a greater or lesser height relative to the wedges. Adjusting the height of the ball transfer units relative to the wedges affects the gimbal point, whether or not the curvature of the wedges is adjusted. Thus, a shim disposed beneath a housing or lower ring or jacking screw operably connected to the housing may be used to quickly adjust the pivot point. Similarly, the angle of the ball transfer unit may be adjusted in order to adjust the pivot point.

Preferably, the pivot point is set at the center of the wafer/pad interface. Placing the pivot point at this location greatly reduces the moment that causes drag on the wafer. Thus, when the pivot mechanism tilts the wafer, the edge of the wafer will remain flush against the pad (with no tendency to tip or dig the wafer edge into the soft polishing pad). This arrangement is preferred for processes in which film removal is uniform across the surface of the wafer.

The pivot point may be set above the center of the wafer, and thus inside the carrier, by adjusting the curvature of the bearing faces of the wedges. In this embodiment, the center 99 of imaginary sphere 98 is set inside the carrier at a point along carrier axis 113, and the curvature and orientation of the bearing faces of the wedges and the orientation of the ball transfer units are adjusted accordingly. When the pivot point is set inside the carrier the leading edge of the wafer will tend to be forced down onto the pad during polishing, thereby increasing the amount of wear on the edges of the wafer relative to the center of the wafer. This arrangement is preferable for processes in which wafer wear preferentially occurs at the center of the wafer, so as to achieve uniform, global removal of material across the wafer surface.

The pivot point may be set at a point below the center of the wafer (and thus inside the pad). In this embodiment, the center 99 of imaginary sphere 98 is set at a point along carrier rotational axis 113 and below the carrier. The curvature and orientation of the bearing faces of the wedges and the orientation of the ball transfer units are adjusted accordingly. When the pivot point is set below the carrier, the leading edge of the wafer will tend to be forced up and away from the pad. Hence, the wafer leading edge will "ski" across the pad, decreasing the amount of wear on the edges of the wafer relative to the center of the wafer. Since the leading edge of the wafer tends to be forced up, this configuration also allows more slurry to get between the wafer and the pad. This arrangement is preferable for processes in which wafer wear occurs preferentially on the edges of the wafer, so as to achieve uniform, global removal of material across the wafer surface.

The pivot point affects the choice of size, dimensions and orientation of the ball transfer units because the ball transfer units directly face the corresponding bearing faces of the wedges. In the carrier of FIGS. 3 and 4, the orientation of the ball transfer units is set by the angle of bores 114 within the housings. (The bores also allow the ball transfer units to be screwed, bolted, or otherwise removably or permanently secured within the housings 29.) In general, the angle of the ball transfer units is the angle between the pressure plate and a radial line of imaginary sphere 98 drawn from the center of the sphere, through the center of a load ball and to the center of a corresponding wedge. The center of curvature of the bearing face of the corresponding wedge also lies along this line; thus, the load balls directly face the corresponding bearing faces of the wedges.

A ball transfer unit includes an outer casing 115, a hemispherical cup member, load plate or striker plate 116, a plurality of small roller balls or ball bearings 117 disposed around the striker plate, a load ball 41 disposed against the ball bearings and a ball-retaining ring 118. The larger load ball can rotate smoothly under heavy loads along any angle relative to the center of the load ball. A spring may be provided within or under the ball transfer unit to provide a radially outwardly urging force or bias to the load ball. (Other ball transfer unit designs also allow for the load ball be biased against the corresponding wedge.) In other embodiments, the ball transfer unit may be designed without a striker plate, in which case the ball bearings fill the void between the load ball and the ball transfer unit housing.

The ball-receiving insert 42 is made of a material that is resistant to wear and corrosion in order to resist deterioration by slurry that leaks into the carrier. Suitable materials for the ball-receiving insert include silicon nitride (SiN), hardened steel (such as 17-4PH steel), Cronidur 30™ (an alloy of C (0.3), Cr (15), Mo (0.98), N (0.4), Si (1), Mu (1) and Fe (81.32)) and X.D15N.W™ (an alloy of C (0.42), Cr (16), Mo (1.8), V (.35), N (0.2) and Fe (81.23)). Similarly, the load ball and ball transfer unit also comprise materials that are highly resistant to wear and to slurry. Suitable materials include Cronidur 30™, X.D15N.W™, 17-4PH steel, SiN and other highly durable materials. Cronidur 30™, X.D15N.W™, 17-4PH steel and SiN are available from vendors such as SKF, Ferrolegeringar AG Zurich and Balden. cronidur 30™ is a martensitic through-hardened steel that can also be induction case hardened. Suitable ball transfer units may be purchased from vendors such as Alwayse UK or SKF. Tests were conducted on many different materials for the ball transfer units and ballreceiving inserts, and most materials did not have the durability required to resist the corrosion and physical wear that occurs over the expected life of a wafer carrier. Thus, the preferred embodiments use these materials.

In addition to the pivot mechanism, the wafer carrier may be provided with a housing ring 94. Tubes may be provided to transfer fluids or a vacuum to various parts of the wafer carrier. The housing upper plate and upper ring may be secured to each other with bolts, screws or other fasteners 119. The lower ring is similarly mounted on the pressure plate. The housing upper plate attaches to the pressure plate via lifting posts 120 disposed through the housing ring. The lifting post is a stainless steel bolt having a polyurethane covering. Three lifting posts secure the housing ring to the pressure plate, though more or less lifting posts may be used. Each lifting post is disposed in a post-hole 121 in the pressure plate, though the lifting post is allowed to move up and down slightly within the post-hole so that the pressure plate can pivot or wobble with respect to the upper plate. A flange 122 may be placed on the lifting post to limit the movement of the lifting post within the post-hole. The total pivoting motion of the lower plate is limited by the lifting post and by the distance (represented by arrows 123) between the pressure plate and the housing ring. In the wafer carriers illustrated above, the pressure plate can pivot or wobble about five degrees around the pivot point.

A means for securing the wafer 3 to the carrier is also provided. The means for securing the wafer to the wafer carrier may comprise a vacuum supplied through channels 124 in the pressure plate 30, a vacuum supplied to a membrane disposed between the pressure plate and the wafer, a retaining ring 125, a combination of these elements or any other suitable means for holding a wafer during polishing.

Figure 5:
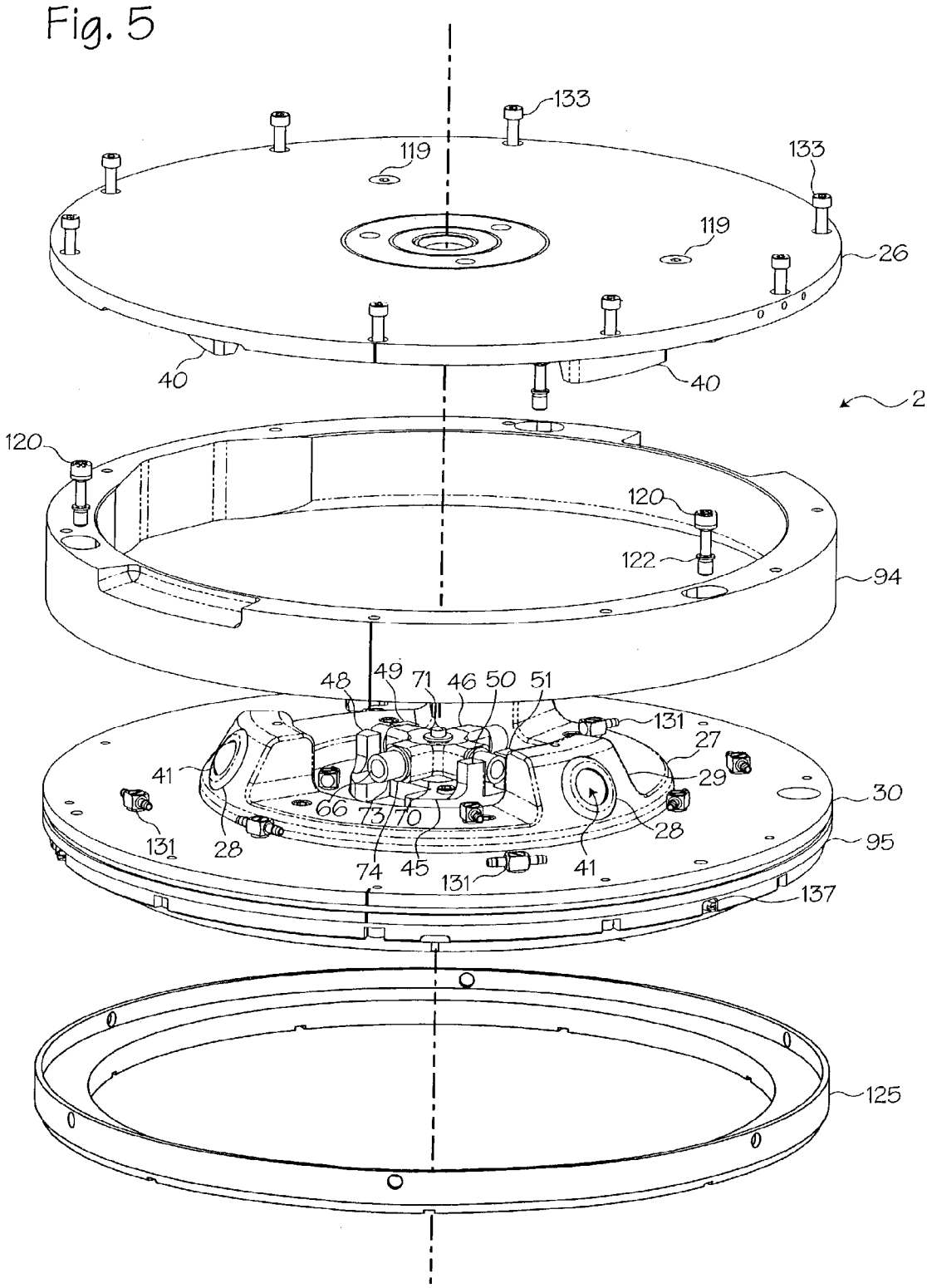
FIG. 5 shows another wafer carrier and wafer carrier pivot mechanism.

FIG. 5 shows another wafer carrier 2 and wafer carrier pivot mechanism. The pivot mechanism is an anodized aluminum upper ring disposed on a ceramic housing upper plate 26, an anodized aluminum lower ring 27 disposed on a stainless steel pressure plate 30, and three CRONIDUR 30™ ball transfer units 28, contained within metal housings 29, mounted on the lower ring and separated by 120° along the lower ring. The upper ring and lower ring are sized, dimensioned and disposed relative to each other so that the lower ring is disposed coaxially under the upper ring when the carrier is assembled. As with the carrier of FIGS. 2 through 4, the carrier of FIG. 5 is also provided with wedges 40 depending from the upper ring, ball-receiving inserts 42 disposed on the bearing faces of the wedges and an expandable universal joint 43 (including a spider 46 disposed between an upper yoke 44 and a lower yoke 45).

The wafer carrier is also provided with a plastic housing ring 94, tubes, tube mounts 131 and a means for securing the wafer to the wafer carrier. The housing ring is secured to the housing upper plate via stainless steel bolts or screws 133. The housing ring is secured to the pressure plate via polyurethane-covered stainless steel lifting posts 120. A stainless steel wafer mounting plate 95 is fixed to the pressure plate 30. Holding pins 137 hold the retaining ring 125 to the wafer mounting plate. An insert is disposed against the wafer mounting plate and is held by the retaining ring. The insert is provided with holes in order to communicate a vacuum from the pressure plate, through the wafer mounting plate, through the insert and to a wafer. During use, the backside of the wafer is disposed against the insert.

In use, a wafer is held on the bottom of the wafer carrier and the wafer carrier moves the wafer onto a polishing pad. A slurry is applied to the polishing pad as the wafer is polished. The wafer carrier and polishing pad are rotated, with the carrier applying a controlled down force on the wafer. Any given point on the wafer will trace a complex path across the surface of the polishing pad. As the wafer moves across the pad, the wafer, the pressure plate and the lower ring wobble around the pivot point in response to variations in the flatness of the pad. The spider wobbles relative to the upper pivot post and the lower pivot post. As the lower ring tilts, the load balls of the ball transfer units roll against the bearing surface of the wedges (and any intervening inserts), thereby keeping the pivoting or wobbling motion continuous and smooth. The smoothness of the pivoting motion increases the planarity of the wafer.

The pivot point may be adjusted to achieve different wear patterns on the wafer. If the pivot point is set below the carrier (inside the pad) then the wafer tends to wear less at the edges relative to the center of the wafer. If the pivot point is set inside the wafer carrier, then the wafer tends to wear more at the edges relative to the center of the wafer.

Other embodiments of the pivot mechanism may be used. The upper or lower rings may be solid (for example, having a frusto-conical shape) to reduce vibrations within the carrier. In this case, the ball transfer units are disposed within the lower ring and roll against the wedges or against the upper ring (if the upper ring is solid). The inwardly facing bearing surface of the upper ring is curved in the same way as described for the bearing faces of the wedges.

In addition, other universal or flexible joints may be used in place of the universal joint shown in FIGS. 1 through 5. For example, a ball and socket joint, a rotary coupling, a flexible drive shaft, a Hooke's joint, a double Hooke's joint, a Bendix-Weiss joint, a spherical four-bar linkage, a Rzeppa joint or any universal joint may replace the universal joint shown in the Figures. Similarly, the spider may comprise a variety of spider types, such as crossed spikes, a disc with bosses or any other suitable spiders.

In some embodiments the inner radius of the upper ring nearly abuts the outer radius of the lower ring. In other embodiments the rings need not have a particular size, though the ball transfer units and the wedges should align with each other to allow the load balls to roll against the wedges during use. In yet other embodiments, the upper ring can have a smaller diameter than the lower ring, in which case the ball transfer units would face inwardly towards the wedges depending from the upper ring. The wedges, in turn, would have outwardly facing bearing surfaces. In addition, the ball transfer units may be disposed on the upper ring and the wedges disposed on the lower ring. In yet other embodiments a plurality of ball transfer units or ball bearings may be disposed along the lower ring (or upper ring) and a plurality of corresponding wedges may be disposed along the upper ring (or lower ring). The ball transfer unit pivot mechanism may be used with membrane-type carriers as well as hard plate carriers. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. A wafer carrier for holding a wafer against a polishing pad in a CMP process, said wafer carrier characterized by a wafer carrier housing adapted to be rotationally fixed to a drive spindle, and a pressure plate disposed coaxially with the carrier housing, said pressure plate adapted to contact the backside of a wafer during polishing, and maintain the front side of the wafer in contact with the polishing pad during CMP, said pressure plate being rotationally fixed to the carrier housing, said wafer carrier further comprising:

a pivoting mechanism comprising:

a first ring having a plurality of ball transfer units affixed thereto, each of said ball transfer units comprising a load ball rotatably disposed within the ball transfer unit;

a second ring, said second ring having bearing surfaces adapted to contact the load balls of the ball transfer units, said second ring disposed coaxially with the first ring with the bearing surfaces disposed in apposition to the load balls;

said pivoting mechanism disposed between the carrier housing and the pressure plate, and secured to the carrier housing and pressure plate so as to permit pivoting motion of the pressure plate relative to the carrier housing;

wherein the ball transfer units are disposed within housings protruding from the first ring toward the second ring, said housings orienting the load balls in apposition to the bearing surfaces of the second ring, and the second ring comprises a plurality of wedges extending toward the first ring, each of said wedges establishing the bearing surfaces in apposition to the load balls.

2. The wafer carrier of claim 1 wherein the bearing surfaces of the second ring are disposed on the second ring to define a spherical section, and are disposed relative to the load balls so as to restrain movement of the load balls to the spherical section.

3. The wafer carrier of claim 2 wherein the bearing surfaces define a spherical section having a center located at the front side of the wafer.

4. The wafer carrier of claim 2 wherein the bearing surfaces define a spherical section having a center displaced from the front side of the wafer.

5. The wafer carrier of claim 2 wherein the bearing surfaces define a spherical section having a center located outside the front side of the wafer, opposite the pressure plate.

6. A wafer carrier for holding a wafer against a polishing pad in a CMP process, said wafer carrier characterized by a wafer carrier housing adapted to be rotationally fixed to a drive spindle, and a pressure plate disposed coaxially with the carrier housing, said pressure plate adapted to contact the backside of a wafer during polishing, and maintain the front side of the wafer in contact with the polishing pad during CMP, said pressure plate being rotationally fixed to the carrier housing, said wafer carrier further comprising:

a housing plate;

a plurality of ball transfer units operably disposed between the housing plate and the pressure plate such that the pressure plate may pivot with respect to the housing plate, each of said ball transfer units comprising a load ball rotatably disposed with a housing;

a plurality of wedges attached to the housing plate, each of said wedges comprising a wedge of non-resilient material having a bearing surface, wherein each of the wedges corresponds to a ball transfer unit;

wherein the ball transfer units are attached to the pressure plate; and wherein the housing plate, pressure plate, each of the ball transfer units and each of the wedges are sized, dimensioned and aligned with respect to each other such that a load ball of a ball transfer unit may roll against the bearing surface of a corresponding wedge.

7. The wafer carrier of claim 6 further comprising a first ring of nonresilient material attached to the pressure plate, wherein the ball transfer unit housings are mounted on the first ring.

8. The wafer carrier of claim 7 further comprising a second ring of non-resilient material attached to the housing plate, wherein the wedges are mounted to the second ring.

9. The wafer of carrier of claim 6 further comprising a universal joint rotatably connecting the housing plate and the pressure plate.

10. The wafer carrier of claim 9 wherein the universal joint comprises:

a spider disposed between the pressure plate and the housing plate;

a first yoke attached to the pressure plate;

a second yoke attached to the housing plate;

wherein the spider is operably connected to the first yoke and the second yoke.

11. The wafer carrier of claim 10 wherein the universal joint is an expandable universal joint.

12. The wafer carrier of claim 10 further comprising:

a first pivot post connected to the pressure plate and abutting the spider; and a second pivot post connected to the housing plate and abutting the spider.

13. The wafer carrier of claim 6 further comprising a plurality of ball-receiving inserts, wherein each of the ball-receiving inserts is disposed opposite the bearing face of a corresponding wedge.

14. The wafer carrier of claim 13 wherein each of the ball-receiving inserts comprise silicon nitride.

15. The wafer carrier of claim 6 wherein each of the load balls comprises a material selected from the group consisting of 174P8 steel and silicon nitride.

16. The wafer carrier of claim 6 wherein each bearing surface of the wedges is provided with a curvature corresponding to a spherical section and wherein the center of curvature of each bearing surface is set at a point along the rotational axis of the wafer carrier.

17. The wafer carrier of claim 16 wherein said point is also set to correspond to about the front side of a wafer when a wafer is disposed on the wafer carrier.

18. The wafer carrier of claim 6 wherein each bearing surface of the wedges is provided with a curvature corresponding to a spherical section; wherein the center of curvature of each bearing surface is set at a point located along the rotational axis of the wafer carrier and beneath the wafer front side.

19. The wafer carrier of claim 6 wherein each bearing surface of the wedges is provided with a curvature corresponding to a spherical section and wherein the center of curvature of each bearing surface is set at a point located along the rotational axis of the wafer carrier and above the wafer front side.

20. The wafer carrier of claim 6 wherein the pivot point of the wafer carrier is located about at the interface of a wafer and a polishing pad when a wafer is located on the wafer carrier and a polishing pad is placed in contact with the wafer.

21. The wafer carrier of claim 6 wherein the pivot point of the wafer carrier is located beneath the wafer carrier.

22. The wafer carrier of claim 6 wherein the pivot point of the wafer carrier is located within the wafer carrier.

23. A wafer carrier for holding a wafer against a polishing pad in a CMP process, said wafer carrier characterized by a wafer carrier housing adapted to be rotationally fixed to a drive spindle, and a pressure plate disposed coaxially with the carrier housing, said pressure plate adapted to contact the backside of a wafer during polishing, and maintain the front side of the wafer in contact with the polishing pad during CMP, said pressure plate being rotationally fixed to the carrier housing, said wafer carrier further comprising:

a housing plate rotatably connected to the pressure plate;

three ball transfer units mounted on the pressure plate, each of said ball transfer units comprising a load ball rotatably disposed within a housing;

three wedges attached to the housing plate, each of said wedges comprising a wedge of a non-resilient material having a bearing surface, wherein each of the wedges corresponds to a ball transfer unit;

wherein the pressure plate, housing plate, each of the ball transfer units and each of the wedges are sized, dimensioned and aligned with respect to each other such that the load ball of a ball transfer unit may roll against the bearing surface of a corresponding wedge;

a spider disposed between the pressure plate and the housing plate;

a first yoke attached to the pressure plate;

a second yoke attached to the housing plate;

wherein the spider is operably connected to the first yoke and the second yoke.

* * * * *